US005994654A

United States Patent [19]

Benson

[11] Patent Number: 5,994,654

[45] Date of Patent: Nov. 30, 1999

[54] ROTARY SWITCH HAVING SPRING LEAF ELECTRICAL CONNECTORS

[76] Inventor: Raymond Benson, 2184 Beech Daly Rd., Dearborn Hgts., Mich. 48127

[21] Appl. No.: 09/184,142

[22] Filed: Oct. 5, 1998

[51] Int. Cl.[6] ..... H01H 1/25

[52] U.S. Cl. ..... 200/283; 200/284

[58] Field of Search ..... 200/520–536, 200/292, 284, 282; 439/76.1, 79, 80, 852, 853, 857

[56] References Cited

U.S. PATENT DOCUMENTS 4,909,743 3/1990 Johnson et al. ..... 439/60

5,001,316 3/1991 Salaman ..... 200/527

5,847,345 12/1998 Harrison ..... 200/284

*Primary Examiner*—Michael L. Gellner

*Assistant Examiner*—Nhung Nguyen

*Attorney, Agent, or Firm*—Charles W. Chandler

[57] ABSTRACT

A rotary push-type stepper switch can include a printed circuit board that acts as a support mechanism for tubular electrical connectors extending beyond the edge of the board through cut-outs in the perimeter wall of a switch housing. Each tubular connector has an upstanding tab extending through the circuit board, so that the tubular connector has good surface area support on the board lower surface. Each tubular connector has two cantilever spring leaf elements adapted to grip the surfaces of a spade terminal inserted into the respective connector.

8 Claims, 2 Drawing Sheets

ROTARY SWITCH HAVING SPRING LEAF ELECTRICAL CONNECTORS

BACKGROUND AND SUMMARY OF THE INVENTION

This invention relates to a rotary stepper switch that includes a stationary circuit board in a switch housing and plural electrical connectors attached to the undersurface of the circuit board. Each electrical connector extends through a perimeter wall of the housing, whereby external spade terminals can be inserted into the electrical connectors for connection of the switch to an external circuit controlled by the switch.

The invention is particularly concerned with the electrical connector structure, such that a firm electrical pressure contact is established between each electrical connector and each associated spade terminal. Each electrical connector comprises two cantilever spring leaves having facing end surfaces adapted to have pressure contact with face areas of an associated spade terminal.

The invention is an improvement on, or variant of, the invention disclosed in U.S. Pat. No. 5,001,316, issued to Mauricio Salaman on Mar. 19, 1991. In the switch construction shown in that patent the external circuit is connected to the switch terminals by means of soldered connections between the external flexible lead wiring and the switch remains. The present invention proposes an alternative arrangement wherein the external circuitry comprises spade-type terminals having slidable plug-on connection with hollow tubular electrical connectors embodied in the switch. Each tubular connector has two opposed spring leaves having end surfaces adapted to press firmly against flat surfaces on the associated spade terminal.

Specific features of the invention will be apparent from the attached drawing and description of an illustrative embodiment of the invention.

DESCRIPTION OF A PREFERRED EMBODIMENT OF THE INVENTION

The drawings show a rotary stepper switch that is constructed similarly, in most respects, to the switch shown in issued U.S. Pat. No. 5,001,316. The switch comprises a two piece housing 10 formed by an upper housing section 12 and lower housing section 14. The two housing sections are assembled together by four posts 16 integral with housing section 12; each post extends downwardly through a mating hole in housing section 14, after which the end of each post is heat staked to secure the two housing sections together.

Figure 1:
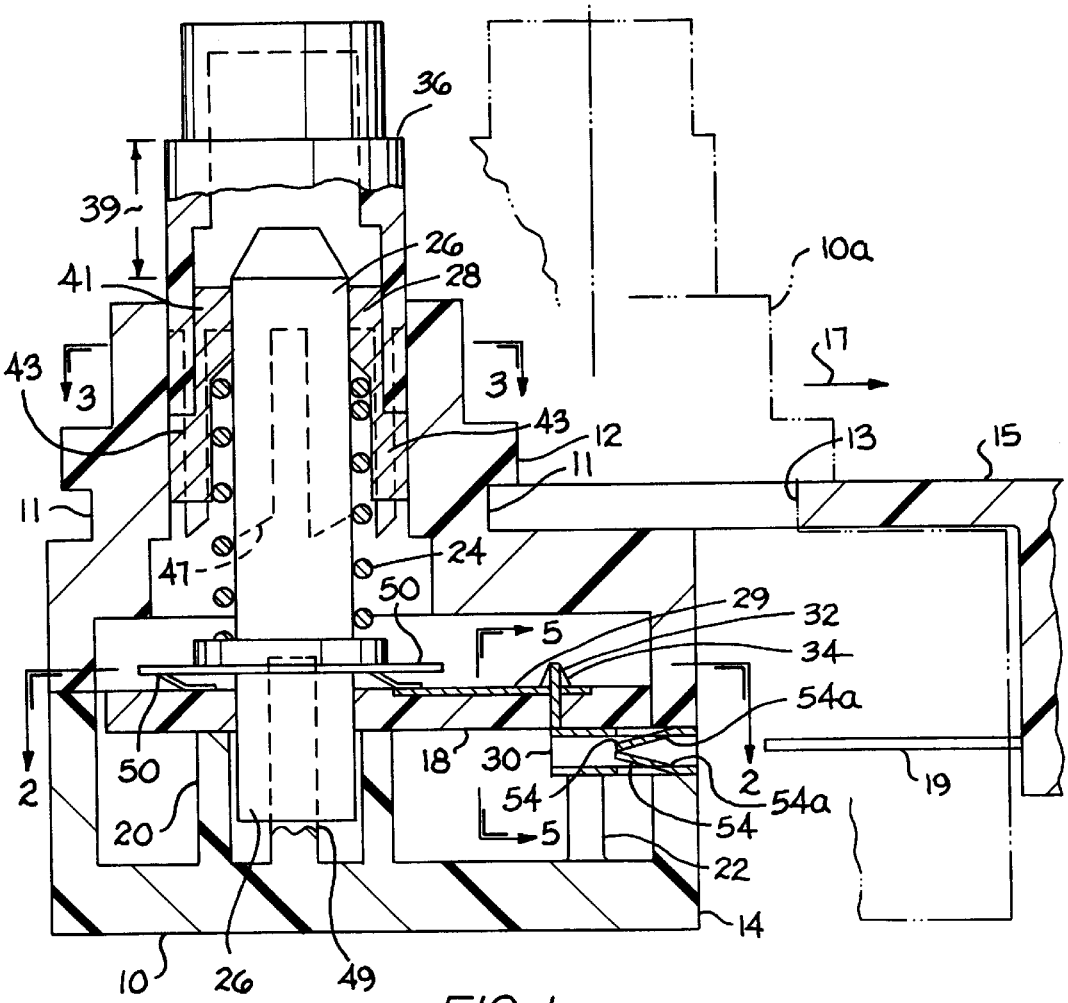
FIG. 1 is a sectional view taken through a rotary stepper switch constructed according to the present invention.

Housing 10 has an annular external groove 11 adapted to mate with a semi-circular recess 13 in the edge of a support wall 15, whereby housing 10 can be moved to a supported position on wall 15 by sliding the housing rightwardly, as denoted by arrow 17 in FIG. 1. Dashed line 10*a* in FIG. 1 shows the housing in its final supported position. Three spade type electrical terminals 19 project from the support structure for insertion into three aligned tubular casing electrical connectors 30 carried by the switch housing 10 (when the housing is moved to the dashed line position).

Figure 2:
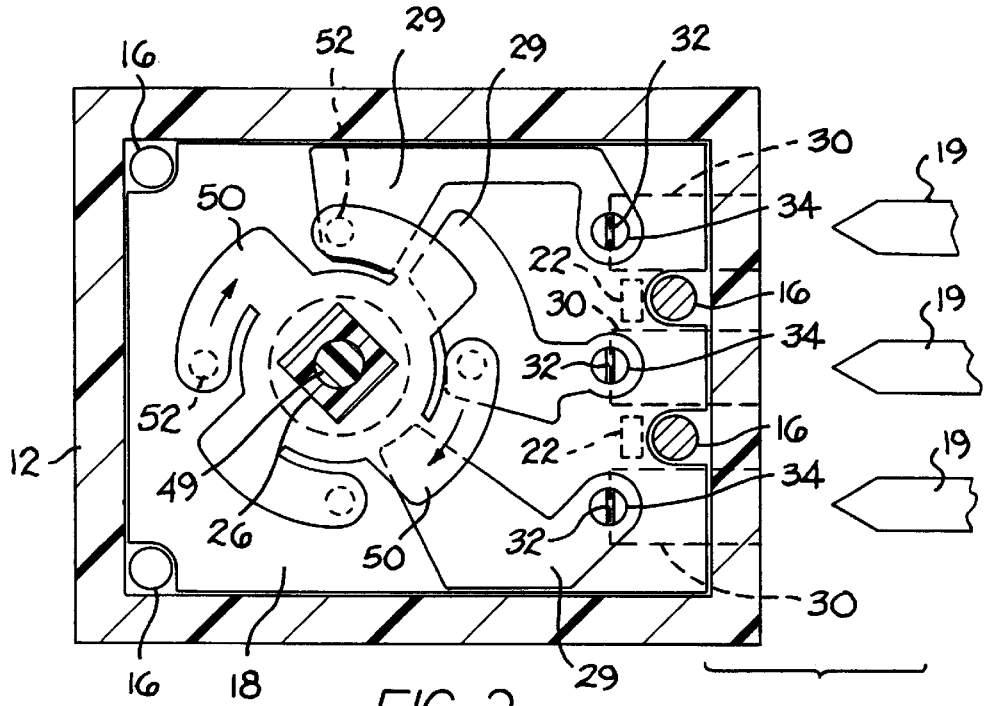
FIG. 2 is a sectional view taken on line 2—2 in FIG. 1.

An essentially rectangular circuit board 18 is positioned in housing 10 by means of an annular support wall 20 and two upstanding support pins 22 integral with housing sectional 14. As shown in FIG. 2, circuit board 18 has side edges in close proximity to the interior surfaces of housing 10, to stabilize the board in the horizontal plane. Upward displacement of the circuit board is precluded by a compression coil spring 24 trained between a circular flange on a rotary pine 26 and an annular actuator 28 that is keyed to pin 26. Pin 26 has a square (non-circular) cross section.

The upper surface of circuit board 18 has three printed circuit areas 29 that are electrically connected (individually) to electrical connectors 30 by means of tabs 32 that extend upwardly from the connectors through slots in board 18. Each tab 32 has a soldered connection 34 to one of the printed circuit areas 29 on the board upper surface. Each electrical connector 30 has the same construction.

Figure 3:
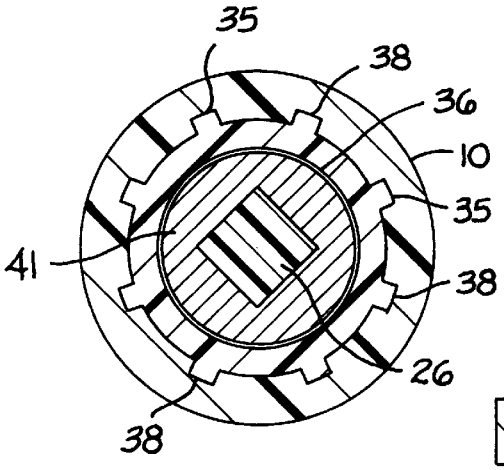
FIG. 3 is a sectional view taken on line 3—3 in FIG. 1.
Figure 4:
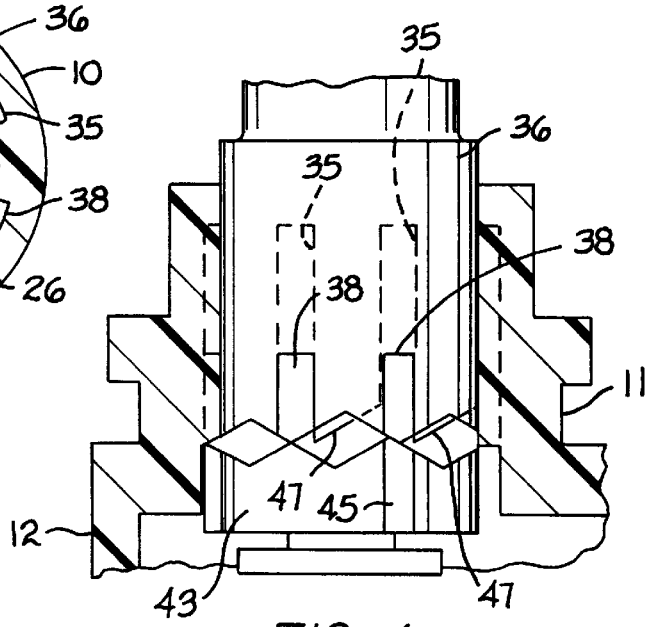
FIG. 4 is a fragmentary sectional taken in the same direction as FIG. 1, but showing the switch actuation plunger at the bottom of its stroke.

The rotary stepper switch includes a hollow plunger 36 slidably mounted in housing section 12 for linear vertical motion normal to the plane of circuit board 18. As shown in FIG. 3, plunger 36 has eight radial ribs 38 that slidably mate with grooves 35 in the housing 10 internal surface, whereby the plunger can move linearly, but not rotatably. The plunger stroke is denoted by numeral 39 in FIG. 1. FIG. 1 shows the plunger at the upper end of the stroke. FIG. 4 fragmentarily shows the plunger at the bottom of the stroke.

The aforementioned annular actuator 28 has an upper cylindrical section 41 located within plunger 36 (as shown in FIG. 3), and a lower externally ribbed section 43 located below plunger 36. Four equidistantly spaced external ribs 45 on section 43 of the annular actuator 28 are slidably keyed to alternate ones of the aforementioned grooves 35 (until the FIG. 4 position is reached).

The upper annular edge of actuator section 43 has plural ridges that help to index the actuator rotationally when the FIG. 4 position is reached. Mating ridges on the lower edge of plunger 36 act at cam surfaces (or relief areas) to facilitate rotational forces on actuator 28 after the FIG. 4 position is reached.

As shown in FIG. 4, ribs 45 on actuator 28 are aligned with selected ribs 38 on plunger 36. When the plunger reaches the end of the downstroke, spring 24 (FIG. 1) immediately returns the plunger and actuator 28 to the FIG. 1 position. Cam surfaces 47, connecting the lower ends of grooves 35, exert cam forces on the angled upper ends of ribs 45, whereby actuator 28 is indexed rotationally during the upstroke of the plunger and actuator.

The aforementioned pin 26 is rotatably supported on a circular post 49 (FIG. 1) carried by housing section 14, whereby actuator 28 and pin 26 rotate together while the actuator is moving upwardly in housing 10. Pin 26 rotates, but does not move vertically.

A switching member 50 is keyed to pin 26 so as to rotate through a predetermined stroke during each plunger 36 down-up cycle. Circular dimple-type contacts 52 on the lower surface of member 50 ride on the upper surface of circuit board 18 to move between different ones of the printed circuit areas 29. Each push on plunger 36 indexes switching member 50 through a predetermined rotational stoke.

The overall operation of the switch is the same as that of the push-push stepper witch shown in aforementioned U.S.

Pat. No. 5,001,316. The present invention is concerned primarily with the construction of each tubular casing electrical connector 30, and its relation to circuit board 18.

Figure 5:
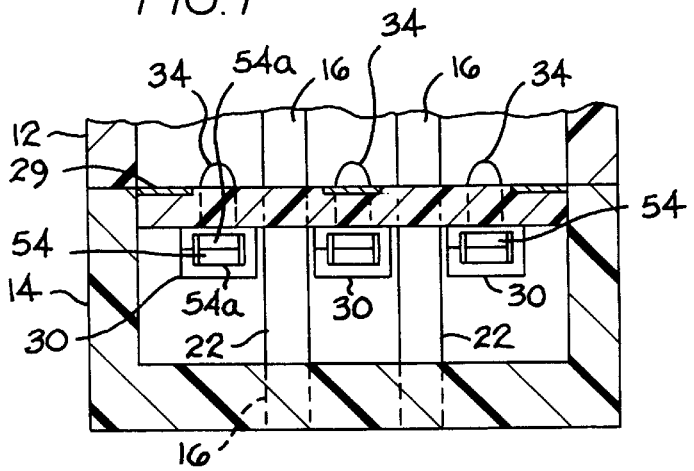
FIG. 5 is a transverse fragmentary sectional view taken on line 5—5 in FIG. 1.

Each electrical connector 30 comprises a four sided tubular casing having a rectangular cross section, as viewed in FIG. 5. The tubular casing includes an upper flat wall seated against the undersurface of circuit board 18 and a second lower flat wall that is parallel to the upper wall; the tubular casing further includes two side walls connecting the upper and lower walls.

A tab 32, integral with the casing upper wall, extends upwardly through a slot in circuit board 18 so as to communicate with one of the printed circuit areas 29 on the board upper surface. A solder connection 34 secures the tab and tubular casing to the circuit board and also establishes an electrical connection between the respective printed circuit area 29 and the tubular casing.

As shown best in FIG. 1, the tubular casing has two internal cantilever spring leaf members 54 angling from the casing upper and lower walls so that the free ends of the spring leaf members are in contact (or close proximity to each other). Each spring leaf member 54 is struck out of the material that forms the respective casing wall.

When the switch housing 10 is moved to the dashed line position 10*a* (FIG. 1), the spade terminals 19 automatically enter into the tubular casing electrical connector 30 so as to spread apart the spring leaf members 54. The facing end surfaces 54*a*, 54*a* of the spring leaf members thus have pressure contact with flat surface areas on opposite sides of the spade terminals.

The spring leaf members 54 initially have relatively slight angulations to the casing walls, as shown in FIG. 1, such that deflections of the spring leaf members by the spade terminals produce a relatively good surface area contact between the spade terminal and both leaf members.

The spade terminals do not act as support members for the switch. Support for the switch is provided by support wall 15. Tolerance controls on the switch housing enable terminals 19 to achieve good pressure contact with spring leaf members 54.

Each individual spade terminal does not have to be located on precisely the midplane of the tubular casing electrical connector 30. Some variation in the spade terminal placement, above or below the connector 30 midplane, can be tolerated.

As shown in FIGS. 1 and 2, each connector 30 extends beyond the edge of circuit board 18 and through the adjacent perimeter wall of housing 10. Each tubular casing electrical connector 30 extends through a cut-out (or notch) in the upper edge of housing section 14; the lower edge of housing section 12 is brought down to a plane defined by the undersurface of circuit board 18, so that each electrical connector 30 has a close clearance with respect to the surrounding housing wall surfaces. Each tubular casing is supported by the solder connection 34 at the upper end of tab 32. The tab extends through the circuit board so that the upper flat wall of the tubular casing 30 has good facial engagement with the circuit board lower face.

The illustrated switch is designed so that it can be constructed as a miniature structure requiring minimal installation space. For example, the switch height from the plunger upper face to the housing bottom surface can be about one inch.

The drawings necessarily show a specific embodiment of the invention However, it will be appreciated that some variation in structural detail can take place while still practicing the invention.

Having described my invention, I claim:

1. A rotary push-button switch, comprising:

a switch housing;

a circuit board located within said switch housing;

plural electrical connectors seated against said circuit board, each of said connectors comprising a hollow casing of an electrically conductive material, and having an opening for receiving an external spade terminal having a free end, and a pair of spaced parallel side walls;

a pair of cantilever leaf members (54*a*, 54*a*) struck from said spaced parallel side walls of the hollow casing so as to be resiliently moveable toward one another, said leaf members having moveable free ends disposed a distance less than the thickness of a spade terminal, facing contact surfaces in close proximity to one another, and fixed ends spaced a distance greater than the thickness of the spade terminal;

whereby a spade terminal is receivable in the hollow casing opening between the fixed ends of the cantilever leaf members in an insertion direction toward the free ends of the leaf members to form an opening therebetween for receiving the spade terminal such that opposed sides of the spade terminal engage the contact surfaces of the pair of leaf members, to establish pressure contact between said leaf members, and the free end of the spade terminal extends beyond the leaf member free ends so as to be frictionally squeezed between the leaf members as the spade terminal is moved in a reverse direction, toward the casing opening.

2. The switch of claim 1, wherein each said electrical connector comprises a tubular casing having a rectangular cross section; each said casing having a first flat wall seated against said circuit board and a second flat wall parallel to said first flat wall; said spring leaves comprising a first cantilever leaf member struck from said first flat wall and a second cantilever leaf member stuck from said second flat wall.

3. The switch of claim 2, wherein each said electrical connector comprises a tab integral with each said first flat wall of the associated tubular casing; each said tab extending angularly from said first flat wall through the circuit board to establish an electrical connection between circuitry on the board and the associated spring leaves.

4. The switch of claim 1, wherein each said hollow casing has a flat wall seated against said circuit board and a tab extending angularly from said flat wall through said circuit board to establish an electrical connection between circuitry on the board and the associated spring leaves.

5. The switch of claim 1, wherein each said electrical connector comprises a tubular casing seated against said circuit board and a tab extending from said tubular casing through said circuit board to establish an electrical connection between circuitry on the board and the associated spring leaves; each said tubular casing extending beyond said circuit board out of the switch housing so as to be accessible for insertion of an external spade terminal into the respective tubular casing.

6. The switch of claim 1, wherein said switch housing comprises a housing section (12) encircling said circuit board; each said electrical connector comprising a tubular casing seated against said circuit board and a tab extending angularly from said tubular casing through said circuit board to establish an electrical connection between circuitry on said board and the associated spring leaves; each said tubular casing extending beyond said circuit board through said housing wall.

7. The switch of claim 1, and further comprising a plunger slidably mounted in said housing for movement normal to said circuit board, a rotary electrical switching member slidably seated on said circuit board, and means between said plunger and said rotary switching member for producing rotary motion of said switching member in response to reciprocatory movement of said plunger.

8. The switch of claim 7, wherein said switch housing comprises a perimeter wall encircling said circuit board; wherein each said electrical connector comprises a tubular casing having a rectangular cross section; each said casing having a first flat wall seated against said circuit board and a second flat wall parallel to said first flat wall; said spring leaves comprising a first cantilever leaf member stuck out of said first flat wall and a second cantilever leaf member struck out of said second flat wall; and a tab integral with each said first flat wall of the associated tubular casing; each said tab extending angularly from said first flat wall through the circuit board to establish an electrical connection between circuitry on the board and the associated spring leaf members; each said tubular casing extending beyond said circuit board through said switch housing perimeter wall.

* * * * *